US006585850B1

(12) United States Patent
Kenji et al.

(10) Patent No.: US 6,585,850 B1
(45) Date of Patent: Jul. 1, 2003

(54) RETAINING RING WITH A THREE-LAYER STRUCTURE

(75) Inventors: Suzuki Kenji, Narita (JP); Gen Yasuhara, Chiba (JP); Yoshihiro Sunada, Narita (JP)

(73) Assignee: Applied Materials Inc., Santa Clara, CA (US)

( * ) Notice: Subject to any disclaimer, the term of this patent is extended or adjusted under 35 U.S.C. 154(b) by 157 days.

(21) Appl. No.: 09/698,842

(22) Filed: Oct. 27, 2000

(30) Foreign Application Priority Data

Oct. 29, 1999 (JP) ..... 11-308105

(51) Int. Cl.[7] ..... B24B 5/00; B24B 37/04
(52) U.S. Cl. ..... 156/345.12; 451/286
(58) Field of Search ..... 156/345.12; 451/286

(56) References Cited

U.S. PATENT DOCUMENTS

| | | | | |
|---|---|---|---|---|
| 5,205,082 A | | 4/1993 | Shendon et al. | |
| 5,423,558 A | | 6/1995 | Koeth et al. | |
| 5,584,751 A | | 12/1996 | Kobayashi et al. | |
| 5,605,488 A | | 2/1997 | Ohashi et al. | |
| 5,635,083 A | | 6/1997 | Breivogel et al. | |
| 5,643,061 A | | 7/1997 | Jackson et al. | |
| 5,645,474 A | * | 7/1997 | Kubo et al. | 451/287 |
| 5,695,392 A | | 12/1997 | Kim | |
| 5,759,918 A | | 6/1998 | Hoshizaki et al. | |
| 5,851,140 A | | 12/1998 | Barns et al. | |
| 6,077,385 A | * | 6/2000 | Kimura et al. | 156/345 |
| 6,251,215 B1 | | 6/2001 | Zuniga et al. | |

FOREIGN PATENT DOCUMENTS

| | | |
|---|---|---|
| EP | 0 747 167 A2 | 12/1996 |
| EP | 0 790 100 A1 | 8/1997 |
| EP | 0 841 123 A1 | 5/1998 |
| GB | 2 307 342 A | 5/1997 |

* cited by examiner

*Primary Examiner*—Benjamin L. Utech
*Assistant Examiner*—Sylvia R. MacArthur
(74) *Attorney, Agent, or Firm*—Fish & Richardson

(57) ABSTRACT

A wafer polishing apparatus 19 comprising a polishing head 3 having a retainer ring 20 provided around the periphery of a wafer W for suppressing movement of the wafer W in the radial direction during polishing. The retainer ring 20 comprises an attachment plate 21 affixed to the polishing head 3, a ceramic friction ring 22 brought into contact with a polishing pad 2, and a resin spacer 23 provided between the attachment plate 21 and the friction ring 22.

13 Claims, 3 Drawing Sheets

RETAINING RING WITH A THREE-LAYER STRUCTURE

TECHNICAL FIELD

The present invention relates to a polishing head in a wafer polishing apparatus used in the chemical machine polishing (CMP) of wafers.

BACKGROUND

Among conventional wafer polishing apparatus comprising polishing heads with retainer rings, there are, for example, those having the structure shown in FIG. 3. This wafer polishing device 1 comprises a polishing pad 2 which is rotated horizontally, and a polishing head 3 which conveys a wafer W by suction and presses the wafer W against said polishing pad 2 from above while horizontally rotating it.

The polishing head 3 comprises a carrier head 4 which is provided so as to be capable of horizontal rotation and moved up-down and left-right by a drive mechanism that is not shown, a wafer holding portion 5 attached to the carrier head 4 so as to be capable of moving in an up-down direction, for holding a disc-shaped wafer W with the surface to be polished face down and for applying pressure to the wafer W from above during polishing and an annular retainer ring 6 attached to the carrier head 4 and provided in a radially outward direction of said wafer holding portion 5.

In the drawing, reference number 7 denotes a membrane composed of a rubber membranous material for applying pressure or suction to wafers, reference number 8 denotes a membrane support for supporting the membrane, reference number 9 denotes an inner tube, reference numbers 10 and 11 denote expandable and contractible sealing means and reference numbers 12, 13 and 14 denote air pressure ducts.

At the polishing head 3 constructed in this way, air pressure fed through the duct 12 causes the first compression chamber 15 to expand to press the retainer ring 6 against the polishing pad 2. Additionally, by supplying a negative pressure through the duct 13, the second compression chamber 16 is made to contract, thus drawing the wafer W up against the wafer holding portion 5, whereas a supply of positive pressure causes the second compression chamber 16 to expand so as to press the wafer W against the polishing pad 2. Furthermore, by supplying air pressure to the duct 14, the inner tube 9 is made to expand, thus pressing the wafer holding portion 5 downward along with the wafer W.

Thus, by adjusting the air pressure supplied to these ducts 12, 13 and 14, the retainer ring 6 is capable of moving up and down independent of the wafer holding portion 5, so that pressure applied from above when polishing the wafer W will press the frictional surface 6*a* on its bottom end against the polishing pad 2. That is, the retainer ring 6 is brought into contact with the polishing pad 2 when polishing the wafer W, thereby sealing off the space in the radial outward direction of the wafer W and preventing the wafer W from flying out in a radial outward direction.

Additionally, if pressure is further applied to the retainer ring 6 while polishing a wafer W, the reaction from the polishing pad 2 will cause the surface of the polishing pad 2 inside the retainer ring 6 to bulge in a so-called rebound effect. Then, by adjusting the pressure applied to the retainer ring 6 by making use of this rebound effect, the state of polish of the wafer W can be changed actively. That is, the retainer ring 6 also functions as means for adjusting the state of polish of the wafer W.

As shown in FIG. 3, the retainer ring 6 which has these functions has a two-layer structure comprising a steel attachment plate 17 affixed to the carrier head 4, and a frictional layer 18 composed of PPS resin (polyphenylene sulfide resin) affixed to the attachment plate 17 by arbitrary attachment means such as a screw or adhesive which is not shown.

SUMMARY

In one aspect, the invention is directed to a retainer ring for a polishing head of a wafer polishing apparatus. The retaining ring has an attachment plate to be affixed to the polishing head, a ceramic friction ring to be brought into contact with a polishing pad, and a resin spacer provided between the attachment plate and the friction ring.

Implementations of the invention may include one or more of the following. The friction ring and the spacer may be respectively formed into an annular shape and positioned adjacent to each other in an axial direction. The spacer may include a covering portion formed on the inner circumferential portion of the spacer. The covering portion may extend along the axial direction in the direction of the friction ring to cover an inner circumferential surface of the friction ring. The inner circumferential edge on a spacer side of the friction ring may be formed in a tapered shape, and the covering portion of the spacer may be formed into a shape that complements the tapered shape. An inner diameter of the spacer may be smaller than an inner diameter of the friction ring. The covering portion of the spacer may have a tip at a position which is set back from a surface of said friction ring which is brought into contact with the polishing pad. A step difference between the tip of the covering portion and the surface of the friction ring may be smaller than a thickness of a circumferential edge of a wafer held by the polishing head. The friction ring may be composed of ceramic SiC, and the retainer ring may be composed of Delrin®.

In another aspect, the invention is directed to a polishing head for chemical mechanical polishing. The polishing head has a wafer mounting surface and a retainer ring provided around the periphery of a wafer on the wafer mounting surface for suppressing movement of said wafer in the radial direction during polishing. The retainer ring includes an attachment plate to be affixed to the polishing head, a ceramic friction ring to be brought into contact with a polishing pad, and a resin spacer provided between the attachment plate and the friction ring.

In another aspect, the invention is directed to a chemical mechanical polishing apparatus. The apparatus has a polishing surface and a polishing head to hold a wafer against the polishing surface. The polishing head includes a wafer mounting surface and a retainer ring provided around the periphery of a wafer on the wafer mounting surface for suppressing movement of said wafer in the radial direction during polishing. The retainer ring includes an attachment plate to be affixed to the polishing head, a ceramic friction ring to be brought into contact with the polishing pad, and a resin spacer provided between the attachment plate and the friction ring.

Possible advantages of the invention may include one or more the following. Microscratches on the surface of a wafer being polished may be reduced. The lifetime of the retaining ring may be increased, and number of preservation or refurbishing steps for the retaining ring may be reduced.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION

Figure 3:
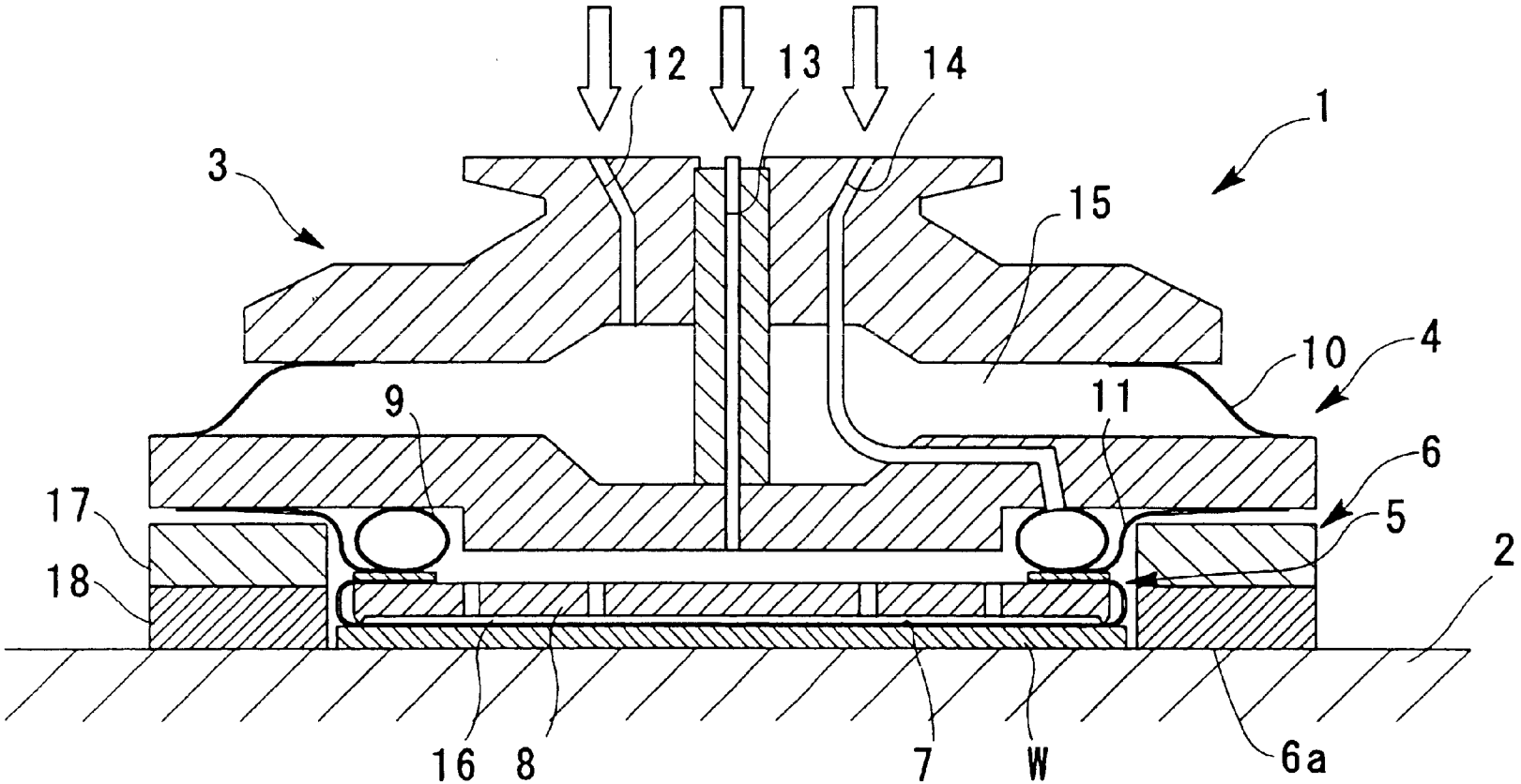
FIG. 3 is a schematic vertical section view showing a conventional wafer polishing apparatus.

Continuing to refer to FIG. 3, since PPS resin is a comparatively soft material, the frictional layer 18 can wear rather quickly depending on the pressure applied to the retainer ring 6. When the frictional layer 18 has worn down by a certain amount, the retainer ring 6 must be exchanged, and preservation or refurbishing work must be performed often if the frictional layer 18 is composed of PPS resin.

Additionally, when the frictional layer 18 is worn, the shavings can remain on the polishing pad 2 and cause microscratches on the surfaces of wafers being polished. In order to prevent the occurrence of microscratches, an operation to remove shavings of the frictional layer 18 from the polishing pad 2 is necessary, thus increasing the number of work steps.

These problems can be avoided by composing the frictional layer 18 from a hard material which has little wear. However, simply replacing the material of the frictional layer 18 from PPS resin to a hard material can quickly damage the polishing pad 2 when the pressure on the polishing pad 2 becomes high.

Furthermore, if the frictional layer 18 is composed of a hard material, the outer circumferential edge of the wafer or the inner circumferential edge of the frictional layer 18 may be damaged by contact between the frictional layer 18 and the wafer W during polishing, and fragments therefrom may cause scratches on the surface of the wafer W being polished.

In view of the forgoing, it would advantageous to provide a retainer ring as part of a wafer polishing apparatus capable of polishing the surface of a wafer without generating microscratches from shavings of the retainer ring or fragments from the wafer.

In brief, in the present invention the polishing apparatus has a polishing head with a three-layered retainer ring. The three-layered retaining ring includes an attachment plate, a resin spacer and a ceramic friction ring. This retainer ring need not result in sudden wear even if brought into contact with a polishing pad with great pressure being applied because the friction ring pressed against the polishing pad is composed of a ceramic material. In addition, because the amount of shavings generated from the retaining ring is also small, the retaining ring effectively suppresses or reduces the occurrence of microscratches on the surface of the wafer being polished.

An implementation a wafer polishing apparatus according to the present invention is described with reference to FIGS. 1 and 2. In the following description, the same reference numbers are used for the portions of the wafer polishing apparatus 9 according to the present embodiment which have the same structure as the conventional wafer polishing apparatus 1 shown in FIG. 3, and their description shall be simplified.

Figure 1:
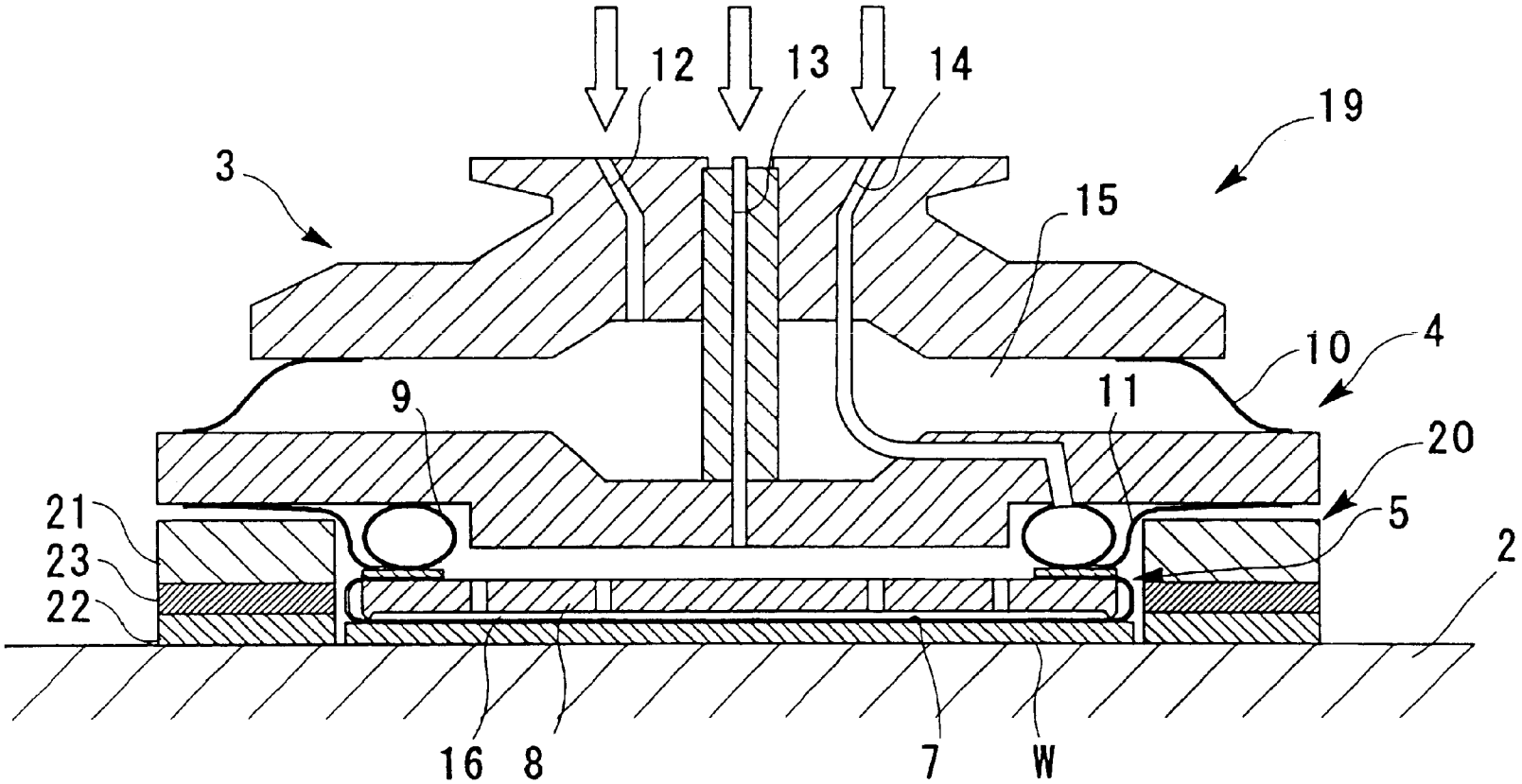
FIG. 1 is a schematic vertical section view of an embodiment of a wafer polishing apparatus according to the present invention.
Figure 2:
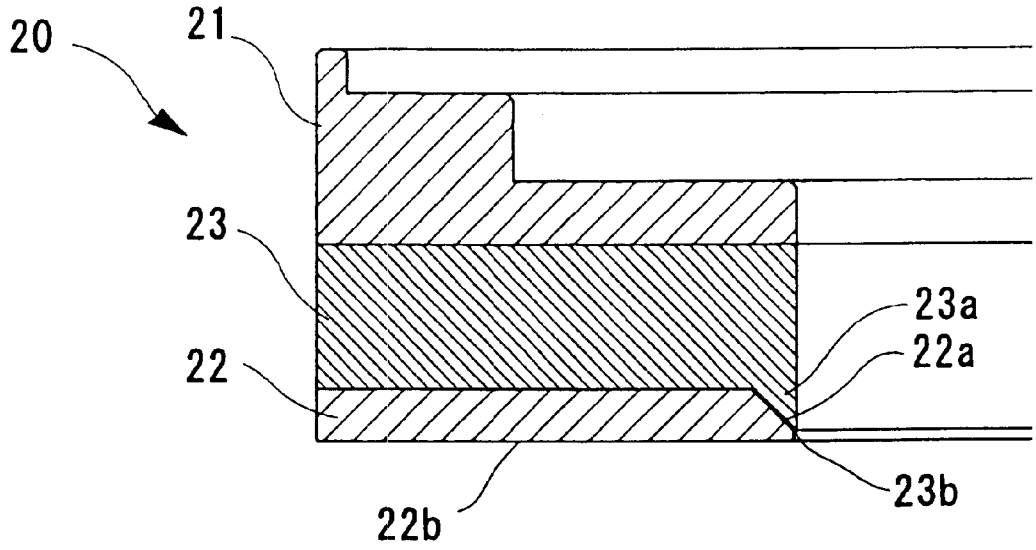
FIG. 2 is a schematic partial vertical section view of a retainer ring used in the wafer polishing apparatus of FIG. 1.

Referring to FIGS. 1 and 2, a wafer polishing apparatus 19 differs from the conventional polishing apparatus in the structure of retainer ring 20. The retainer ring 20 of the wafer polishing apparatus 19, as shown in FIG. 1, is a three-layered annular member composed of an attachment plate 21 affixed to the carrier head 4, a friction ring 22 which is brought into contact with the polishing pad 2 and a spacer 23 provided between the friction ring 22 and the attachment plate 21.

The attachment plate 21 is a steel annular member which is affixed to the carrier head 4 by arbitrary attachment means such as screws which are not shown.

The spacer 23 is an annular member composed of a resin such as Delrin®, affixed to the attachment plate by screws, adhesive or both which are not shown:

The friction ring 22 is an annular member composed of a ceramic such as SiC ceramic, affixed to the spacer 23 by screws and adhesive which are not shown.

The friction ring 22 is provided with a beveled portion 22*a* which is tapered on the inner circumferential edge of the upper side as shown in FIG. 2. This beveled portion 22*a*, for example, is formed over a slightly smaller measurement than the thickness of the friction ring 22 at an angle of 45°.

The spacer 23 is provided with a covering portion 23*a* having a shape that roughly complements the beveled portion 22*a* on the inner circumferential edge on the lower side adjacent to the friction ring 22. That is, the covering portion 23*a* is an annular projection having a vertical cross section that roughly complements the vertical cross section of the beveled portion 22*a*, and is formed so as to protrude from the spacer 23 in an axial direction.

As a result, when the friction ring 22 and the spacer 23 are placed adjacent each other and stabilized, the covering portion 23*a* of the spacer 23 fits snugly into the beveled portion 22*a* of the friction ring 22, thereby filling it. Consequently, the covering portion 23*a* roughly covers the inner circumferential surface of the friction ring 22.

The inner diameter of this spacer 23 is formed slightly smaller than the inner diameter of the friction ring 22. For example, in the present embodiment, the inner circumferential surface of the spacer 23 is made to protrude by approximately 0.4 mm in the radially inward direction from the inner circumferential surface of the friction ring 22.

Furthermore, the covering portion 23*a* of the spacer 23 is made slightly shorter than the thickness of the friction ring 22. That is, the tip 23*b* of the covering portion 23*a* extends to a position which is set back from the frictional surface 22*b* of the friction ring 22, so as not to contact the polishing pad 2. For example, in the present embodiment, the distance between the tip 23*b* of the covering portion 23*a* and the frictional surface 22*b* of the friction ring 22 is set to approximately 0.3 mm, which is smaller than the thickness of the outer circumferential edge of the wafer W.

The polishing of a wafer W by a wafer polishing apparatus according to the present embodiment structured in this way shall be described below.

First, a negative pressure is supplied to the duct 13 to draw up the wafer W with the wafer holding portion 5, and the carrier head 4 is rotated while bringing the polishing head 3 into contact with the horizontally rotating polishing pad 2. At this time, a slurry containing polishing material is fed between the polishing head 3 and polishing pad 2.

Next, air pressure is supplied to the ducts 12, 13 and 14, to generate a pressure for pressing the wafer W and retainer ring 20 against the polishing pad 2.

When pressure is applied to the retainer ring 20, the friction ring 22 is pressed against the polishing pad 2, but since the friction ring 22 is formed of a ceramic material in the wafer polishing apparatus of the present embodiment, there is little wear and the generation of shavings is reduced. Therefore, it is possible to prolong the replacement period of the retainer ring 20 and reduce the number of operations required for preservation or refurbishment.

As discussed, a resin spacer 23 is provided between the ceramic friction ring 22 and the steel attachment plate 21. In this case, the buffer effect of the spacer 23 prevents excessive contact pressure from being generated between the friction ring 22 and the polishing pad 2. Thus, although a hard friction ring 22 is used, the damage to the polishing pad 2 can be kept low.

Additionally, by bringing the rotating wafer W into contact with the rotating polishing pad 2, a force which urges the wafer W in a radial outward direction is applied, but due to the retainer ring 20 which is provided around the wafer holding portion 5, the space around the wafer W is sealed off, thereby preventing the wafer W from flying off.

In this case, the wafer W mechanically contacts the retainer ring 20, but since the retainer ring 20 of the wafer polishing apparatus according to the present embodiment is such that the covering portion 23*a* which covers the inner circumferential surface of the friction ring 22 is provided with a spacer 23, the wafer W contacts only the covering portion 23*a* which is a portion of the resin spacer 23, thus affording protection from contact with the hard friction ring 22. Consequently, damage to the wafer W or retainer ring 20 due to contact between the retainer ring 20 and wafer W is prevented.

In this way, the generation of shavings due to wear on the retainer ring 20 and generation of torn fragments due to contact between the wafer W and retainer ring 20 during the polishing of the wafer W can be prevented, thereby effectively reducing or preventing the occurrence of microscratches on the surface of the wafer W being polished due to such shavings or fragments residing on the polishing pad.

Furthermore, a beveled portion 22*a* in the form of a taper is provided on the inner circumferential edge of the friction ring 22, and the covering portion 23*a* for covering this is shaped so as to complement the beveled portion 22*a*, thus enabling the covering portion 23*a* which is shaped such as to protrude from the spacer 23 to have sufficient mechanical strength. As a result, it is possible to prevent the covering portion 23*a* from being broken off and coming loose from the spacer 23 even due to prolonged use or frequent collisions with the wafer W.

Additionally, since the inner diameter of the spacer 23 is made slightly smaller than the inner diameter of the friction ring 22, a wafer W contacting the retainer ring 20 will contact only the spacer 23 which is positioned further to the inside, thus reliably preventing contact with the friction ring 22. Furthermore, since there is a step difference between the tip 23*b* of the covering portion 23*a* of the spacer 23 and the frictional surface 22*b* of the friction ring 22, the covering portion 23*a* is prevented from contacting the polishing pad 2 during polishing, thereby preventing the generation of shavings from the spacer 23.

In the wafer polishing apparatus according to the present embodiment, the fiction ring 22 is composed of ceramic SiC and the spacer 23 of Delrin®, but it is just as well possible to use any other appropriate ceramic material or resin material. Additionally, a beveled portion 22*a* having a tapered shape is provided on the inner circumferential edge of the friction ring 22, but the angle and length thereof can be set arbitrarily according to need.

As described in detail above, according to the present invention, a retainer ring with a three-layered structure wherein a ceramic friction ring is provided at a position of contact with the polishing pad and a resin spacer is provided between it and the attachment plate, so that the replacement period of the retainer ring due to wear of the friction ring is made longer so as to reduce the number of steps required for protection, and the spacer acts as a buffer to prevent excessive contact pressures from occurring between the friction ring and the polishing pad. Additionally, since the amount of shavings generated by wear of the friction ring is reduced, the occurrence of microscratches on the surfaces of the wafers being polished can be largely reduced.

Additionally, since a covering portion for covering the inner circumferential surface of the friction ring is provided on the inner circumferential portion of the spacer, it is possible to prevent the wafers from contacting the hard friction ring during polishing. As a result, chipping of the wafer being polished can be effectively prevented, and the occurrence of microscratches due to fragments residing on the polishing pad can be prevented.

While specific examples of the dimensions of the various parts were given in the description of the present implementation, it should be readily apparent that the present invention is not necessarily restricted to these measurements.

One embodiment of the invention has been described. Nevertheless, it will be understood that various modifications may be made without departing from the spirit and scope of the invention. Accordingly, other embodiments are within the scope of the following claims.

What is claimed is:

1. A retainer ring for a polishing head of a wafer polishing apparatus, comprising an attachment plate to be affixed to the polishing head;

a ceramic friction ring to be brought into contact with a polishing pad; and a resin spacer provided between the attachment plate and the friction ring.

2. The retainer ring of claim 1, wherein the friction ring and the spacer are respectively formed into an annular shape and positioned adjacent to each other in an axial direction.

3. The retainer ring of claim 2, wherein the spacer includes a covering portion formed on the inner circumferential portion of the spacer and extending along the axial direction in the direction of the friction ring for covering an inner circumferential surface of the friction ring.

4. The retainer ring of claim 3, wherein the inner circumferential edge on a spacer side of the friction ring is formed in a tapered shape, and the covering portion of the spacer is formed into a shape that complements the tapered shape.

5. The retainer ring of claim 4, wherein an inner diameter of the spacer is smaller than an inner diameter of the friction ring.

6. The retainer ring of claim 5, wherein the covering portion of the spacer has a tip at a position which is set back from a surface of said friction ring which is brought into contact with the polishing pad, and a step difference between the tip of the covering portion and the surface of the friction ring is smaller than a thickness of a circumferential edge of a wafer held by the polishing head.

7. The retainer ring of claim 3, wherein the covering portion of the spacer has a tip at a position which is set back from a frictional surface of said friction ring which is brought into contact with the polishing pad, and a step-difference between the tip of the covering portion and the frictional surface of the friction ring is smaller than a thickness of a circumferential edge of a wafer held by the polishing head.

8. The retainer ring of claim 1, wherein an inner diameter of the spacer is smaller than an inner diameter of the friction ring.

9. The retainer ring of claim 1, wherein the friction ring is composed of ceramic SiC.

10. The retainer ring of claim 1, the spacer is composed of Delrin.

11. A polishing head for chemical mechanical polishing, comprising:

a wafer mounting surface; and a retainer ring provided around the periphery of a wafer on the wafer mounting surface for suppressing movement of said wafer in the radial direction during polishing, wherein the retainer ring includes an attachment plate to be affixed to the polishing head, a ceramic friction ring to be brought into contact with a polishing pad, and a resin spacer provided between the attachment plate and the friction ring.

12. A chemical mechanical polishing apparatus, comprising:

a polishing surface; and polishing head to hold a wafer against the polishing surface, the polishing head including a wafer mounting surface and a retainer ring provided around the periphery of a wafer on the wafer mounting surface for suppressing movement of said wafer in the radial direction during polishing, wherein the retainer ring includes an attachment plate to be affixed to the polishing head, a ceramic friction ring to be brought into contact with the polishing pad, and a resin spacer provided between the attachment plate and the friction ring.

13. A retainer ring for a polishing head of a wafer polishing apparatus, comprising:

an attachment plate to be affixed to the polishing head;

a friction ring to be brought into contact with a polishing pad; and a spacer provided between the attachment plate and the friction ring, wherein the friction ring and the spacer are respectively formed into an annular shape and positioned adjacent to each other in an axial direction, and the spacer includes a covering portion formed on the inner circumferential portion of the spacer that extends along the axial direction in the direction of the friction ring and covers an inner circumferential surface of the friction ring.

* * * * *